US006705404B2

(12) United States Patent
Bosley

(10) Patent No.: US 6,705,404 B2
(45) Date of Patent: Mar. 16, 2004

(54) OPEN WELL PLUNGER-ACTUATED GAS LIFT VALVE AND METHOD OF USE

(76) Inventor: Gordon F. Bosley, Box 40, Cherry Grove, Alberta (CA), T0A 0T0

( * ) Notice: Subject to any disclaimer, the term of this patent is extended or adjusted under 35 U.S.C. 154(b) by 0 days.

(21) Appl. No.: 09/948,647

(22) Filed: Sep. 10, 2001

(65) Prior Publication Data

US 2003/0047316 A1 Mar. 13, 2003

(51) Int. Cl.[7] ..... E21B 43/12

(52) U.S. Cl. ..... 166/372; 166/68; 166/108; 166/167; 166/332.4; 166/370; 166/386

(58) Field of Search ..... 166/372, 370, 166/373, 386, 68, 108, 110, 111, 167, 169, 332.4, 332.5

(56) References Cited

U.S. PATENT DOCUMENTS 3,941,510 A * 3/1976 Morgan ..... 417/57
4,036,297 A 7/1977 Swihart, Sr.
4,682,656 A 7/1987 Waters
4,708,595 A 11/1987 Maloney et al.
5,211,242 A 5/1993 Coleman et al.
5,253,713 A 10/1993 Gregg et al.
6,148,923 A 11/2000 Casey
6,170,573 B1 * 1/2001 Brunet et al. ..... 166/153

* cited by examiner

*Primary Examiner*—Zakiya Walker
(74) *Attorney, Agent, or Firm*—Sean W. Goodwin

(57) ABSTRACT

A system is provided for unloading accumulated liquids and enhancing the recovery of gas from a reservoir having diminished pressure. An annulus between a tubing string and casing is isolated by a packer and continually pressurized with a slipstream of compressed gas while the well continues to produce. A unique valve positioned in the tubing string is shuttled between a production position in which production fluids are permitted to bypass the valve to the surface and a lift position in which the bypass is blocked and an unloading port is opened to vent high pressure annulus gas to the tubing string above the valve, lifting accumulated liquids with it. Preferably, the valve is actuated to the lift position by the impact of a plunger dropped from a lubricator at the wellhead, when the pressure in the annulus has reached a predetermined threshold. When the gas has been vented and the pressure in the annulus drops, the valve is actuated to the uphole production position as a result of the higher reservoir pressure.

16 Claims, 9 Drawing Sheets

104, 12
110
105
105
21
21
111
102
103
100
107
107
109
101
109
108
106
106
104
112

134
11
125
124
110
21
135
127
128
25
123
126
130
120
102
132
133
111
129
100
101
121
131
103
136
122
112
137
104
103

OPEN WELL PLUNGER-ACTUATED GAS LIFT VALVE AND METHOD OF USE

FIELD OF THE INVENITON

The present invention relates to apparatus and methods for lifting liquids from a wellbore during production of gas or oil and more particularly to lifting liquids from wellbores where the natural reservoir pressure has diminished over time.

BACKGROUND OF THE INVENTION

It is well known that during the production of hydrocarbons, particularly from gas wells, the accumulation of liquids, primarily water, has presented great challenges to the industry. As the liquid builds at the bottom of the well, a hydrostatic pressure head is built which can become so great as to overcome the natural pressure of the formation or reservoir below, eventually "killing" the well.

A fluid effluent, including liquid and gas, flows from the formation. Liquid accumulates as a result of condensation falling out of the upwardly flowing stream of gas or from seepage from the formation itself. To further complicate the process the formation pressure typically declines over time. Once the pressure has declined sufficiently so that production has been adversely affected, or stopped entirely, the well must either be abandoned or rehabilitated. Most often the choice becomes one of economics, wherein the well is only rehabilitated if the value of the unrecovered resource is greater than the costs to recover it.

A number of techniques have been employed over the years to attempt to rehabilitate wells with diminished reservoir pressure. Some of these are using soap sticks, "pitting" the well occasionally by blowing the well down in a pit to atmospheric pressure, swabbing, injecting high pressure gas into the formation, lowering the end of the tubing string to the perforation, tapering the tubing string to a smaller inner diameter near the surface to increase the flow rate, optimizing tubing size to balance velocity and friction effects, waterflooding the formation to augment pressure depletion, insulating and heating the production tubing string to minimize condensation and liquid fallout and beam lifting.

One common technique has been to shut in or "stop cock" the well to allow the formation pressure to build over time until sufficient to lift the liquids when the well is opened again. Unfortunately, in situations where the formation pressure has declined significantly, it can take many hours to build sufficient pressure to blowdown or lift the liquids, reducing the hours of production. Applicant is aware of wells which must be shut in for 12–18 hours in order to obtain as little as 4 hours of production time before the hydrostatic head again becomes too large to allow viable production.

Two other techniques, plunger and gas lift, are commonly used to enhance production from low pressure reservoirs.

A plunger lift production system typically uses a small cylindrical plunger which travels freely between a location adjacent the formation to a location at the surface. The plunger is allowed to fall to the formation location where it remains until a valve at the surface is opened and the accumulated reservoir pressure is sufficient to lift the plunger and the load of accumulated liquid to the surface. The plunger is typically retained at the wellhead in a vertical section of pipe and associated fitting called a lubricator until such time as the flow of gas is again reduced due to liquid buildup. The valve is closed at the surface which "shuts in" the well. The plunger is allowed to fall to the bottom of the well again and the cycle is repeated. Shut-in times vary depending upon the natural reservoir pressure. The pressure must build sufficiently in order to achieve sufficient energy, which when released, will lift the plunger and the accumulated liquids. As natural reservoir pressure diminishes, the required shut-in times increase, again reducing production times.

Typically, a gas lift production system utilizes injection of compressed gas into production tubing to aerate the production fluids, particularly viscous crude oil, to lower the density and cause the resulting gas/oil mixture to flow more readily to the surface. The gas is typically separated from the oil at the surface, recompressed and returned to the tubing string. Gas lift methods can be continuous wherein gas is continually added to the tubing string, or gas lift can be performed periodically. In order to supply the large volumes of compressed gas required to perform conventional gas lift, large and expensive systems, requiring large amounts of energy, are required. Gas is typically added to the production tubing using gas lift valves directly tied into the production tubing or optionally, can be added via a second, injection tubing string. Complex crossover elements or multiple standing valves are required for implementations using two tubing strings, which add to the maintenance costs and associated problems.

A combination of gas lift and plunger lift technologies has been employed in which plungers are introduced into gas lift production systems to assist in lifting larger portions of the accumulated fluids. In gas lift alone, the gas propelling the liquid slug up the production tubing can penetrate through the liquid, causing a portion of the liquid to escape back down the well. Plungers have been employed to act as a barrier between the liquid slug and the gas to prevent significant fall down of the liquid. Typically, the plunger is retained at the top of the wellhead during production and then caused to fall only when the well is shut in and the while the annulus is pressurized with gas. This type of combined operation still requires that the well be shut in and production be halted each time the liquid is to be lifted.

Clearly, there is a need, in the case of wells having declining natural reservoir pressure, for apparatus and methods that would allow the energy within the annulus to be augmented for lifting the accumulated liquids in the well, without a requirement to shut in the well and halt production.

SUMMARY OF THE INVENTION

In a broad aspect of the invention, a system is provided which enables unloading or lifting of liquids from a gas well to alleviate the associated hydrostatic pressure and thus enhance gas production from a tubing string, without the need to shut-in a well. The annulus is continuously charged with compressed gas to build energy which is periodically released to lift accumulated fluids, using a combination of plunger and gas lift techniques. The wellbore annulus is fitted with a packer to create an annular chamber which can be charged with gas for creating a large pressure differential compared to that present in the reservoir alone.

A shuttle-type valve is located in the production tubing string and is positioned at the base of the wellbore adjacent the packer. The valve is operable between a production position, permitting production of fluids from the formation to the surface, and an unloading or lift position, wherein the gases within the annulus can be discharged through the tubing string, lifting any accumulated liquids to the surface.

A steady slipstream of compressed gas is continuously fed to the packed off annulus while the well continues to produce. When the pressure in the annulus reaches a predetermined threshold, a plunger, which resides in a wellhead lubricator at the surface, is triggered to fall down the tubing string and through any collected liquid. Preferably, the plunger also contacts a valve stem in the valve, actuating the valve stem to a downhole lift position. In the lift position, ports in the valve which normally allow production are blocked and the ports to the annulus are opened, permitting the accumulated pressurized gases in the annulus to vent upwardly through the production tubing, lifting the plunger and the accumulated liquid with it. The plunger is carried up the production tubing with the liquid and gases to the wellhead lubricator where it is caught and held until the unloading cycle is repeated.

The high pressure gas in the annulus vents until the pressure in the formation again exceeds that of the annulus. The higher formation pressure then acts on the valve stem to force it to an uphole production position, opening the production ports to resume production, and blocking the annulus ports so as to allow pressure to begin to accumulate in the annulus once more.

In a preferred embodiment of the invention the valve assembly further comprises a landing spring assembly which acts to "cushion" the impact of the plunger on the valve assembly by absorbing excess force of the falling plunger. The landing assembly comprises an outer spring to absorb the excess energy and an inner spring to accept energy transferred from the outer spring to actuate the valve stem in the valve to the downhole position.

Thus, in a broad aspect of the invention, a system is provided for enhancing gas recovery from a tubing string which extends down a wellbore into a reservoir having diminished pressure wherein the tubing string accumulates liquid, the system comprising:

- a packer between the wellbore and the tubing string for forming an annulus, isolated from the reservoir;
- a source to continuously build pressure within the annulus; and
- a valve positioned in the tubing string adjacent the packer which is actuated, preferably using a plunger, from a production position, wherein production ports are opened and fluidly connected by a bypass chamber in the valve between the reservoir to the tubing string above the valve for producing gas from the reservoir and one or more unloading ports connecting the annulus to the tubing string are blocked, to a lift position, wherein the production ports are blocked and the unloading ports are open for releasing high pressure gas stored in the annulus to the tubing string above the valve to lift and remove accumulated liquids from the tubing string.

Preferably the valve is actuated to the lift position by the impact of a plunger falling down the tubing string and to the production position as a result of differential pressure between the vented annulus and the reservoir. Such a valve would comprise:

- a tubular housing having having an upper production port fluidly connected to the tubing string above the valve, a lower production port fluidly connected to the reservoir below the valve and an unloading port fluidly connecting the isolated annulus to the tubing string above the valve; and
- a valve stem having an uphole and a downhole piston and axially moveable within the housing between a first uphole production position wherein the uphole piston blocks the unloading port, the upper and lower production ports are fluidly connected and the downhole piston opens the reservoir to the lower production port, and a second downhole lift position wherein the downhole piston blocks the reservoir from the lower production port and the uphole piston opens the unloading port.

The above described valve and system enable practice of a novel process described broadly as comprising the steps of: providing a packer between the wellbore and the tubing string for forming an annulus, the annulus being isolated from the reservoir, and a valve located in a bore of the tubing string adjacent the packer; pressurizing the annulus; opening one or more production ports for fluidly connecting the reservoir to the tubing string above the valve while blocking one or more unloading ports connecting the annulus to the tubing to flow reservoir gas; and blocking the production ports and opening the unloading ports to lift accumulated liquids out of the tubing string.

Preferably, the blocking of the ports is accomplished by dropping a plunger down the tubing string so as to impact and actuate the valve from an uphole production position wherein the production ports are open and the unloading ports are blocked to a downhole lift position wherein the production ports are blocked and the unloading ports are open. The valve is preferably returned to the production position when the reservoir pressure exceeds the annulus pressure.

DETAILED DESCRIPTION OF THE PREFERRED EMBODIMENT

Figure 1A:
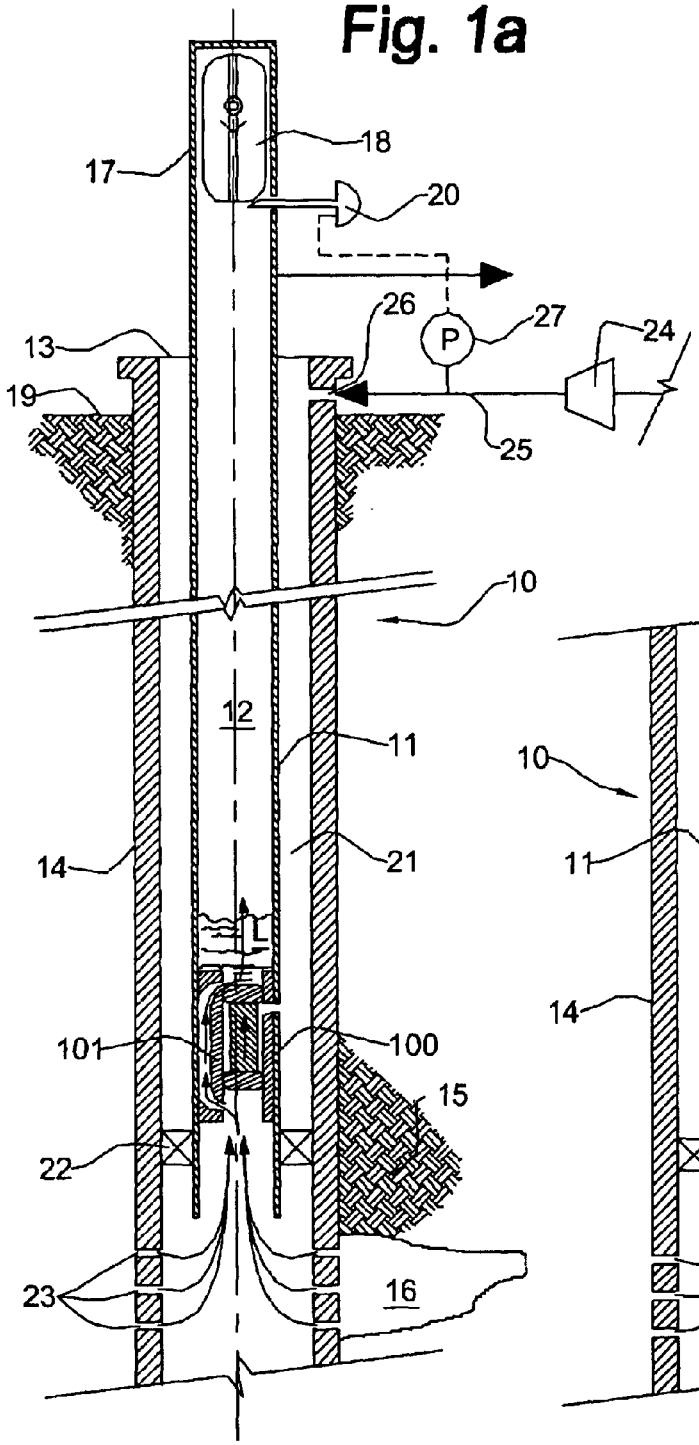
FIG. 1*a* is a schematic representing the plunger-actuated gas lift production system of the present invention with the unloading valve in the production position.
Figure 1B:
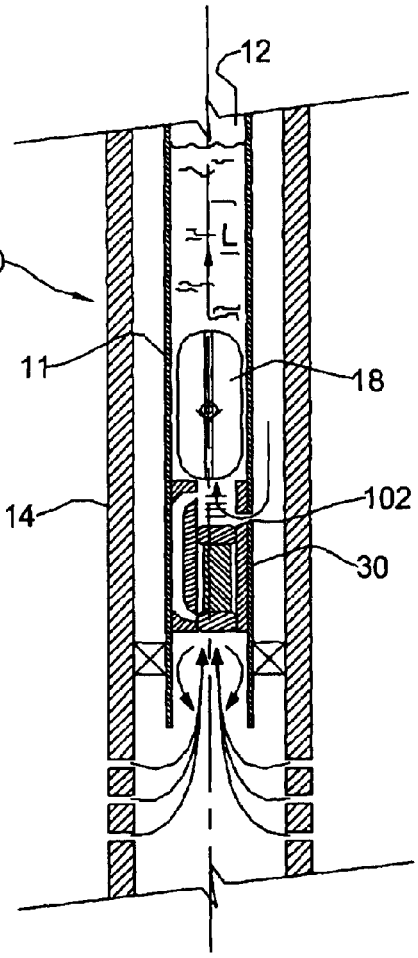
FIG. 1*b* is a schematic representing the plunger-actuated gas lift production system according to FIG. 1*a* with the unloading valve in the lift position.

Having reference to FIGS. 1*a*–1*b*, a plunger-actuated gas lift production system 10, according to the present invention, is shown. The system typically comprises a tubing string 11 having a bore 12 and which extends downhole from a surface wellhead 13. The tubing string 11 extends down a wellbore having a casing 14 and into a formation 15 containing a hydrocarbon reserve or reservoir 16, under pressure.

In a preferred embodiment of the invention, a conventional lubricator 17 and plunger 18, common to conventional plunger-lift systems, are connected to the tubing string 11 at surface 19. The plunger 18 is designed to free fall through the tubing string 11, but is designed to have tolerances sufficiently tight to create a liquid seal when being lifted up the tubing string 11. The plunger 18 is retained in the lubricator 17 by a catching mechanism 20 which is pneumatically controlled by the pressure in an annulus 21.

A conventional packer 22 is set in the wellbore between the casing 14 and the tubing string 11 above a plurality of perforations 23 in the casing 14 which define an isolated area above the packer 22 and to the surface 19, referred to as the annulus 21. Typically, the packer 22 is set as close above the perforations 23 as is possible.

A conventional source of pressurized gas 24, such as a compressor, provides a continuous slipstream of compressed gas into the isolated annulus 21 through a gas inlet port 26 at the wellhead 13. One such compressor, suitable for pressurizing the annulus, is a small 5–15 HP conventional gas compressor package with a prime mover and shut down and safety controls.

An unloading valve 100 is seated in a housing 101 in the bore 12 of the tubing string 11 uphole and adjacent to the packer 22 location. The unloading valve 100 is operable to shuttle between two positions, a first production position wherein formation fluids are allowed to flow to the surface 19 and a second lift position wherein production is temporarily blocked while accumulated liquids L, such as oil and water, are lifted to the surface 19.

In operation, as shown in FIG. 1*a*, the isolated annulus 21 stores energy over time as a result of the influx of compressed gas 25. In the production position the well continues to produce while the annulus 21 builds pressure without having to shut the well in.

Having reference to FIG. 1*b*, when the pressure in the annulus 21 reaches a predetermined threshold, a pneumatic controller 27 releases the plunger 18 from the lubricator 17, causing it to fall down the bore 12 of the tubing string 11, until it contacts the unloading valve 100. The plunger 18 actuates the unloading valve 100 to the lift position, blocking production and opening an unloading port 102, releasing the stored pressurized gas 25 in the annulus 21 to exit via the tubing string 11. Any accumulated liquid L is carried up the tubing string 11 ahead of the plunger 18 and the released gas 25, where it can be discharged at the surface 19. The plunger 18 acts as a plug, lifting the liquids L which have accumulated ahead of it. When the plunger 18 reaches the lubricator 17 at the top of it's cycle, it is again retained in the lubricator 17 until the cycle begins again.

Figure 2A:
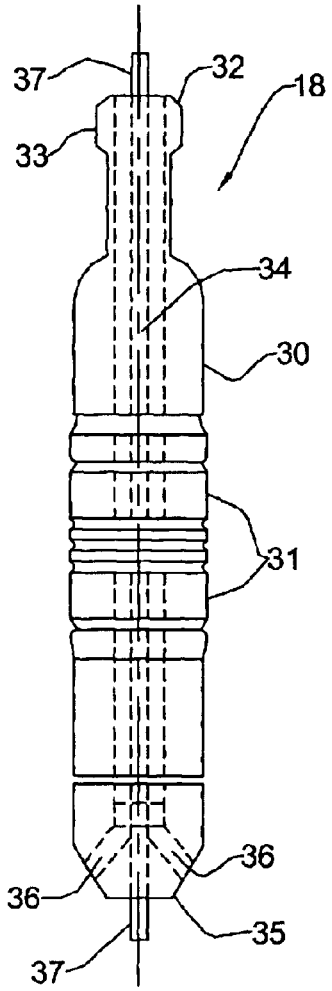
FIG. 2*a* is a schematic representing one embodiment of a conventional plunger.

Having reference to FIG. 2*a*, one such conventional plunger design is shown. The plunger 18 comprises a cylindrical body 30, typically formed of steel, having an exterior diameter smaller than the inside diameter of the tubing string 11 to allow free fall. The exterior of the cylindrical body 30 is fitted with annular spring loaded pads 31 designed to contact the inside of the tubing string 11 and to form a liquid seal therebetween. A top end 32 of the cylinder 30 is formed into a standard API "fish neck" 33 to allow the plunger 18 to be wireline retrievable, should it need to be recovered from the bottom of the tubing string 11. The cylindrical body 30 has a central bore 34 drilled axially therethrough extending from a bottom end 35 of the cylinder 30 to the top end 32 to allow fluids to pass therethrough during fall. Optionally, a series of ports 36 may be added, branching from the central bore 34 to allow a more rapid fluid passage and thus a more rapid descent down the tubing string 11. A rod-actuated shuttle valve (not detailed) is fitted within the cylinder bore 34 and is moveable between a first position wherein the bore 34 is open to the passage of fluids and a second position wherein the bore 34 is closed, by the valve, to the passage of fluids. In the first open position, the plunger 18 is able to fall freely through any accumulated liquid L. In the second closed position, the plunger 18 is operative to act as a plug to lift liquid L from the tubing string 11.

An actuator rod 37 is connected to the plunger valve and is axially movable within the plunger bore 34. The rod 37 protrudes sufficiently outside the bore of the cylindrical body so as to allow impact with an obstruction within the lubricator 17 or downhole in the tubing string 11 to drive the rod 37 axially within the bore 34 to actuate the plunger valve between the open and closed positions, respectively. When the plunger valve is in the closed position, the rod 37 extends above the top of the fish neck 33 and when the plunger valve is in the open position, the rod 37 protrudes from the bottom 35 of the plunger 18.

Figure 2B:
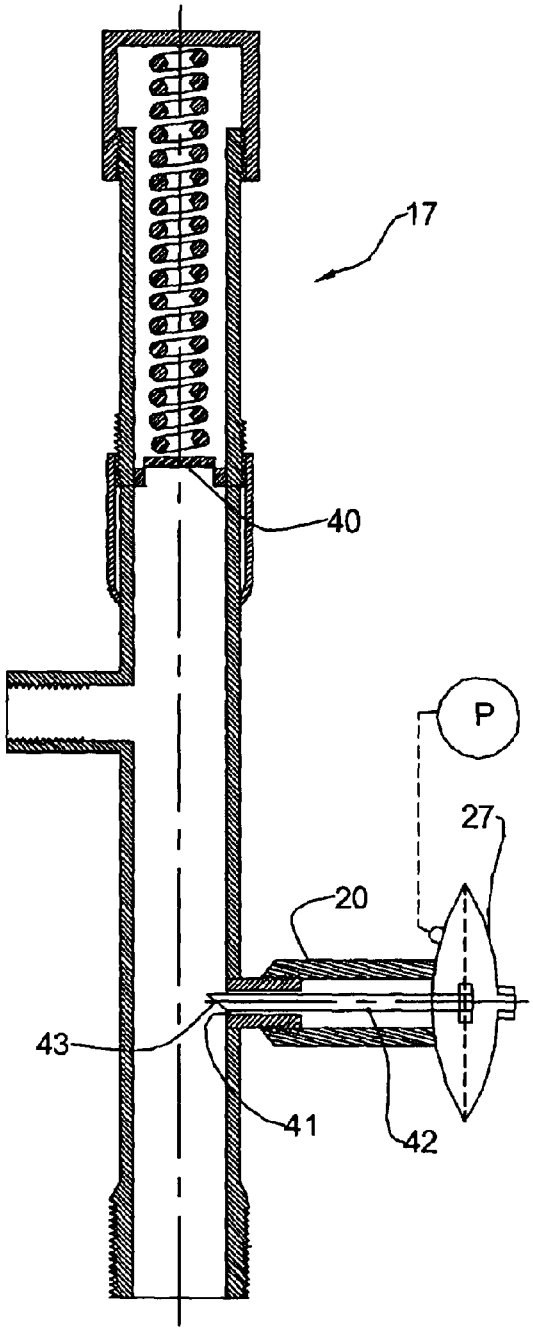
FIG. 2*b* is a schematic representing one embodiment of a conventional lubricator showing the catching mechanism and pneumatic controller.

As shown in FIG. 2*b*, a bumper pad 40 in the lubricator 17 acts as the obstruction at the wellhead 13, causing the actuator rod 37 to move downward within the plunger 18, opening the plunger valve.

The plunger catching device 20 is threadably connected to the lubricator 17 at a side port 41. The catching device 20 comprises a spring-loaded steel pin 42, extending into the lubricator 17 and having the extending end 43 cut at an angle which enables the pin 42 to retract briefly when struck by the arriving plunger 18 and then return, as a result of the spring-loaded action, into the lubricator 17 to prevent the plunger 18 from falling. The pneumatic controller valve 27 is actuated by a pressure switch P on the annulus 21 and acts to retract the pin 42, releasing the plunger 18 when the pressure in the annulus 21 reaches a predetermined threshold.

Figure 3:
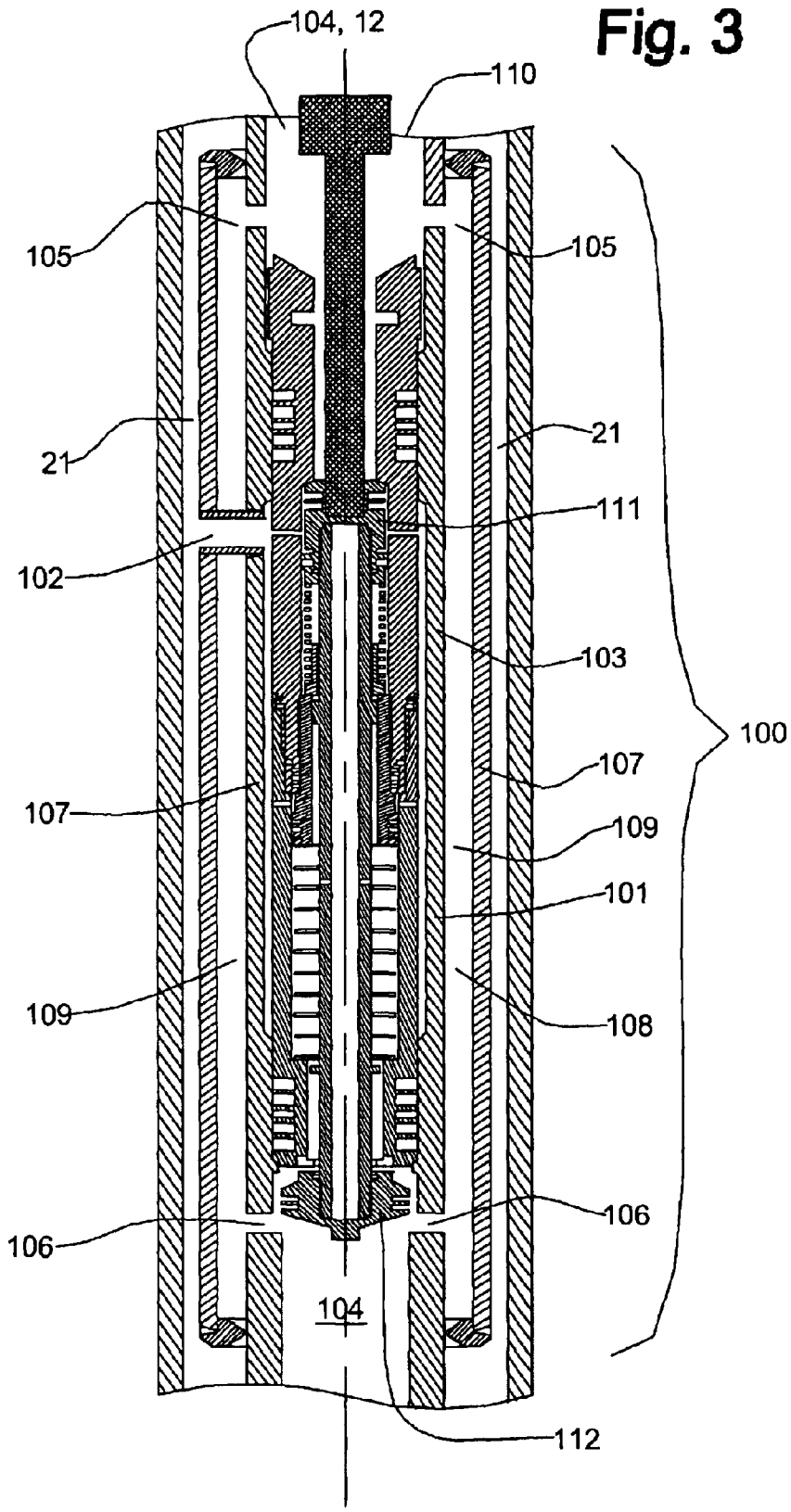
FIG. 3 is a detailed longitudinal cross-sectional view of an unloading valve of the present invention in the production position.

Having reference to FIG. 3 and in greater detail, the unloading valve 100 is positioned in the tubing string 11, typically 2–3 meters above the packer and comprises the tubular housing 101, threaded for connection to the tubing string 11. The tubular housing 101 has an outer wall 103 and a bore 104. The housing bore 103 is coaxial with the bore 12 of the tubing string 11 when the housing 101 is threaded into the tubing string 11, permitting the flow of fluids from the reservoir 16 to the surface 19. Upper and lower production ports 105, 106 are formed in the housing wall 103 and are connected to provide fluid communication therebetween in the production position.

In a preferred embodiment of the invention, an outer tubular sleeve 107 is fitted around the housing 101, extending above and below the production ports 105, 106, and is sealing engaged to an exterior surface 108 of the housing wall 103, forming an annular bypass chamber 109 therebetween to fluidly connect the ports 105, 106. Production fluid flowing from the reservoir 16 can thus enter the bypass chamber 109 via the lower port 106, flow up the bypass chamber 109, bypassing a substantial portion of the unloading valve 100 and reentering the tubing string 11 through the valve's upper port 105 for communication and production to the surface 19. Further, the unloading port 102 is formed through the outer sleeve 107 and the housing wall 103 to permit communication between the annulus 21 and the housing's bore 104, operable during the lift position.

The unloading valve 100 further comprises a valve stem 110 having an uphole piston 111 and a larger downhole piston 112. The valve stem 110 is housed within the housing bore 104 positioned intermediate the upper 105 and lower 106 ports and is movable axially therein between an uphole position and a downhole position.

In the production position, as shown in FIG. 3, the smaller uphole piston 111 is positioned to block the unloading port 102 ensuring there is no communication between the annulus 21 and the tubing string 11. This allows pressure to build in the annulus 21. The upper production port 105 remains open. The larger downhole piston 112 is positioned uphole so that the lower production port 106 is also open. As a result, with both production ports 105, 106 open, fluids are able to bypass the unloading valve 100 and flow to the surface 19 at the same time annulus pressure is increasing, in preparation for an unloading cycle.

Having reference to FIG. 4, in the lift position the downhole piston 112 is positioned downhole from the lower production port 106, sealingly engaging the wall 103 of the housing 101 below production port 106, blocking the flow of fluids from the reservoir 16 and into the housing's bore 104, effectively stopping production. Simultaneously, the uphole piston 111 is positioned sufficiently downhole to open the unloading port 102. High pressure gas 25, stored in the annulus 21, flows through the unloading port 102 and into the tubing string 11, where it rapidly flows to the surface 19, carrying the plunger 18 and any accumulated liquids L ahead of it.

Having reference again to FIG. 4, the unloading valve 100 preferably further comprises a valve body 120 which supports the valve stem 110 within the housing 101. An inner surface 121 of the housing 101 is profiled at one or more locations to form inwardly extending upward facing landing shoulders 122, 123 to support the valve body 120.

The valve body 120 is a tubular body having a bore 124 and having an outer diameter sized to be freely movable within the housing's bore 104 for enabling wireline installation and retrieval to the housing 101. An uphole end 125 of the valve body 120 is profiled with an outwardly extending downward facing shoulder 126 for engaging a landing shoulder 123 of the housing 101, thus limiting the downward movement of the valve body 120 when run into the housing 101 using wireline and for positioning the valve body 120 in relation to the housing ports 102, 105, 106. Preferably the uphole end 125 of the valve body 120 is inwardly tapered to guide a wireline retrieval tool. Optionally, an interior surface 127 of the valve body 120, adjacent the uphole end 125, is further profiled 128 to receive the wireline retrieval tool, to be used in the event that other structures used normally to retrieve the tool are damaged or lost during retrieval.

An exterior surface 129 of the valve body 120 is profiled and fitted with upper and lower valve body seals 130, 131, preferably a combination of polypak and pneumatic seals, to sealingly engage the valve body 120 against the inner wall of the housing 101, between the production ports 105, 106. A series of radially extending ports 132 are formed about the circumference of and through the valve body 120 which correspond with the unloading port 102 in the housing 101, thus completing fluid communication between the annulus 21 and the valve body 120. These ports 131 are alternately closed and opened in the production and lift positions, respectively, by the movement of the upper piston 111.

The interior surface 127 of the valve body 120 is further profiled to accommodate the axially movable valve stem 110 which connects upper 111 and lower 112 pistons. An inwardly extending, downward facing shoulder 133 is formed in the bore 124 of the valve body 120 above the radially extending ports 132 against which the upper piston 111 stops when in the uphole position, limiting the valve stem's movement.

An uphole end 134 of the valve stem 110 extends above the upper piston 111 beyond the uphole end 125 of the valve body 120 to act as a contact surface for the plunger 18. The valve stem's uphole end 134 is sized so as to create an annulus 135 therebetween of sufficient size to allow unrestricted flow of gas 25 from the unloading port 102. Further, the uphole end 134 is used as a "fishneck" for normal wireline retrieval.

Figure 4:
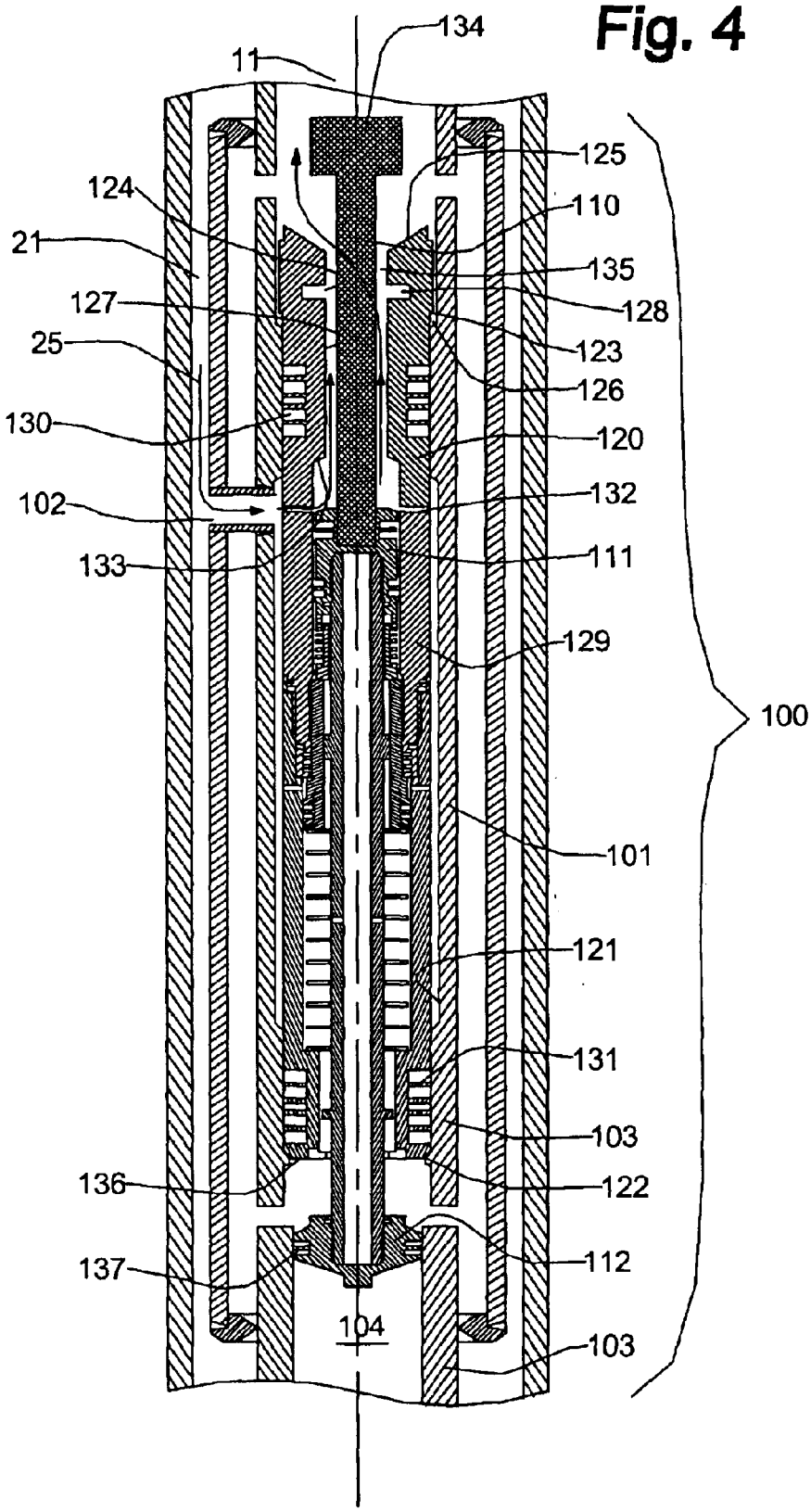
FIG. 4 is a detailed longitudinal cross-sectional view of the unloading valve of FIG. 3 in the lift position.

Again, having reference to FIG. 4, shown in the lift position, the valve stem 110 extends below a downhole end 136 of the valve body 120. The larger downhole piston 112 is provided with seals 137 and is sized so as to sealingly engage the wall 103 of the housing 101. Pressure in the reservoir 16 acts at the larger piston 112 face to move the valve stem 110 to the uphole production position when the pressure in the reservoir 16 is greater than the pressure in the annulus 21.

In summary, valve 100 in the production position, as shown in FIG. 3, begins a production cycle positioned so that the smaller uphole piston 111 blocks the unloading port 102 to allow the pressure to build in the annulus 21, while simultaneously, the lower piston 12 is positioned to open the lower production port 106 and allow production fluids to bypass the unloading valve 100 and flow to the surface 19.

When moved to the lift position by the plunger 18, to begin an unloading cycle as shown in FIG. 4, the uphole piston 111 is positioned downhole to open the unloading port 102, allowing the gas 25 from the annulus 21 to enter the valve body 120 and the tubing string 11, where it lifts the plunger and fluids (not shown) accumulated therein. Simultaneously, the downhole piston 112 is positioned to block the flow of fluids from the reservoir 16 and to act as a check valve, preventing high pressure gas 25 released from the annulus 21 leaking into and shocking the formation 15. When the pressure in the annulus 21 has released, the reservoir pressure acts on the downhole piston 112 to move the valve 100 to the production position to repeat the production cycle once again.

Figure 5:
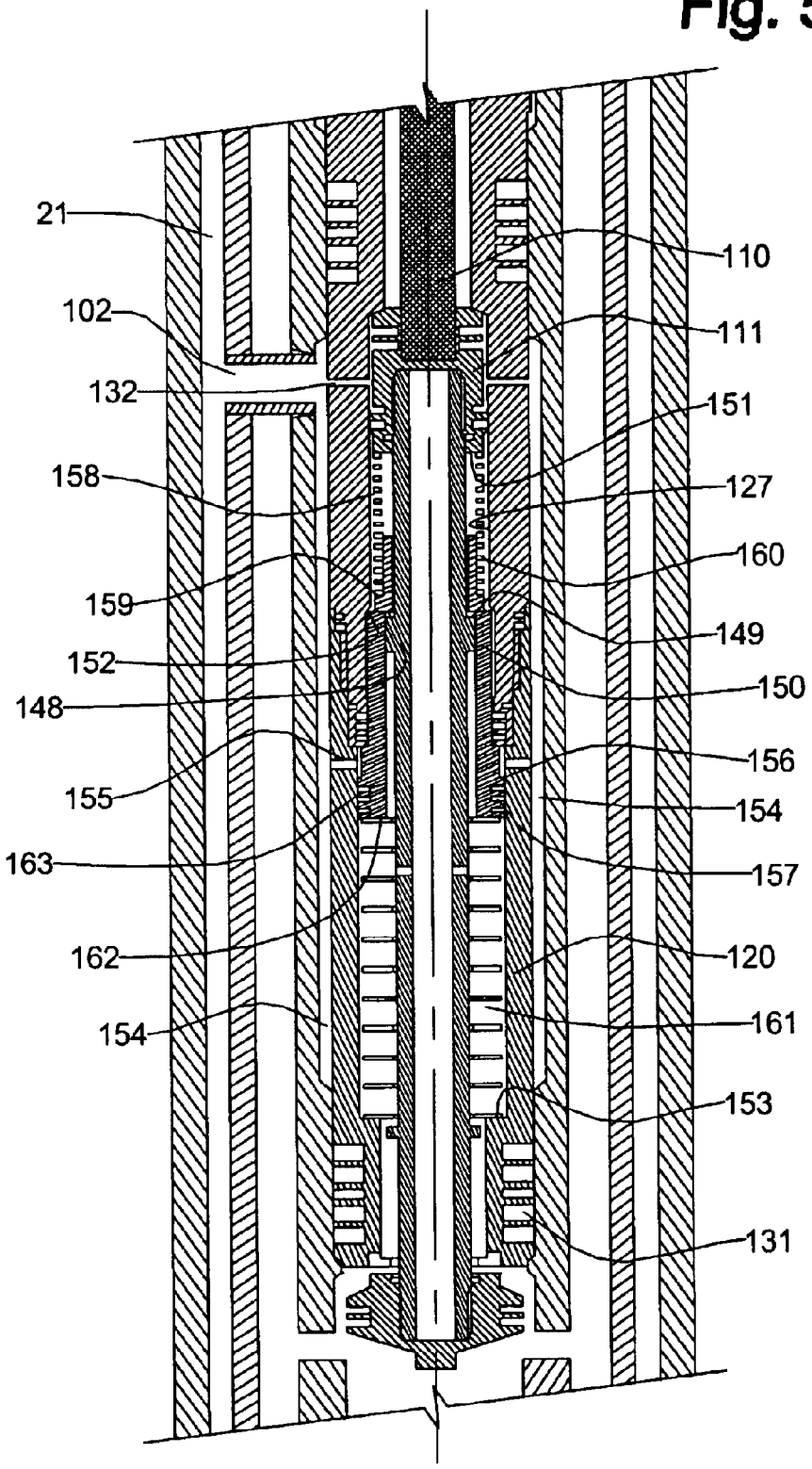
FIG. 5 is a detailed cross-sectional view of a poppet valve located in the unloading valve of FIG. 3, the poppet valve shown in position at the end of the production cycle.

Optionally, as shown in FIG. 5, the valve stem 110 is fit with a gas poppet valve 150 adjacent a lower surface 151 of the uphole piston 111, to advantageously use differential pressure to assist in the axial shifting movement of the valve stem. In the present embodiment, the poppet valve is used in combination with the plunger, and not independently to shift the valve stem. The poppet valve 150 is an annular sleeve fitted between the valve stem 110 and the valve body 120. At the upper end of the poppet, inward shoulders 148 alternately engage a shoulder 149 formed on the valve stem 110, limiting relative axial movement.

The interior surface 127 of the valve body 120 is profiled with an inwardly extending downward facing shoulder 152 below the radially extending ports 132 and an inwardly extending upward facing shoulder 153 adjacent the bottom valve body seals 131 to guide and to limit the axial movement of the poppet valve 150. Further, the interior wall 127 of the housing 101 is profiled to form an annular gallery 154 about the valve body 120 to communicate with the unloading port 102 connected to the well annulus 21. A series of small ports 155 are formed in the valve body 120 adjacent the poppet valve 150 to provide fluid communication between the gallery 154 and the poppet valve 150. The poppet valve 150 is fit with a larger lower piston 156 against which the pressure of the annulus gas 25 acts to assist the downhole axial movement of the valve stem 110. The uphole piston 111 of the valve stem 110 can move independent of the poppet valve piston 156. The poppet valve piston 156 is fit with seals 157 to sealingly engage the piston 156 against the valve body 120. An upper spring 158 is housed between the uphole valve stem piston 111 and the poppet valve 150 and is supported at a lower end by a shoulder 159 formed at a top end 160 of the poppet valve 150. A second larger spring 161 is housed between a bottom end 162 of the poppet valve 150 and the inwardly extending upward facing shoulder 153 of the valve body 120, adjacent the bottom valve body seals 131. The lower spring 161 biases the poppet valve 150 to an uphole position, compressing the upper spring 158 and assisting the valve stem 110 to remain in the uphole position blocking the unloading port 102 as pressure builds in the annulus 21.

Figure 6:
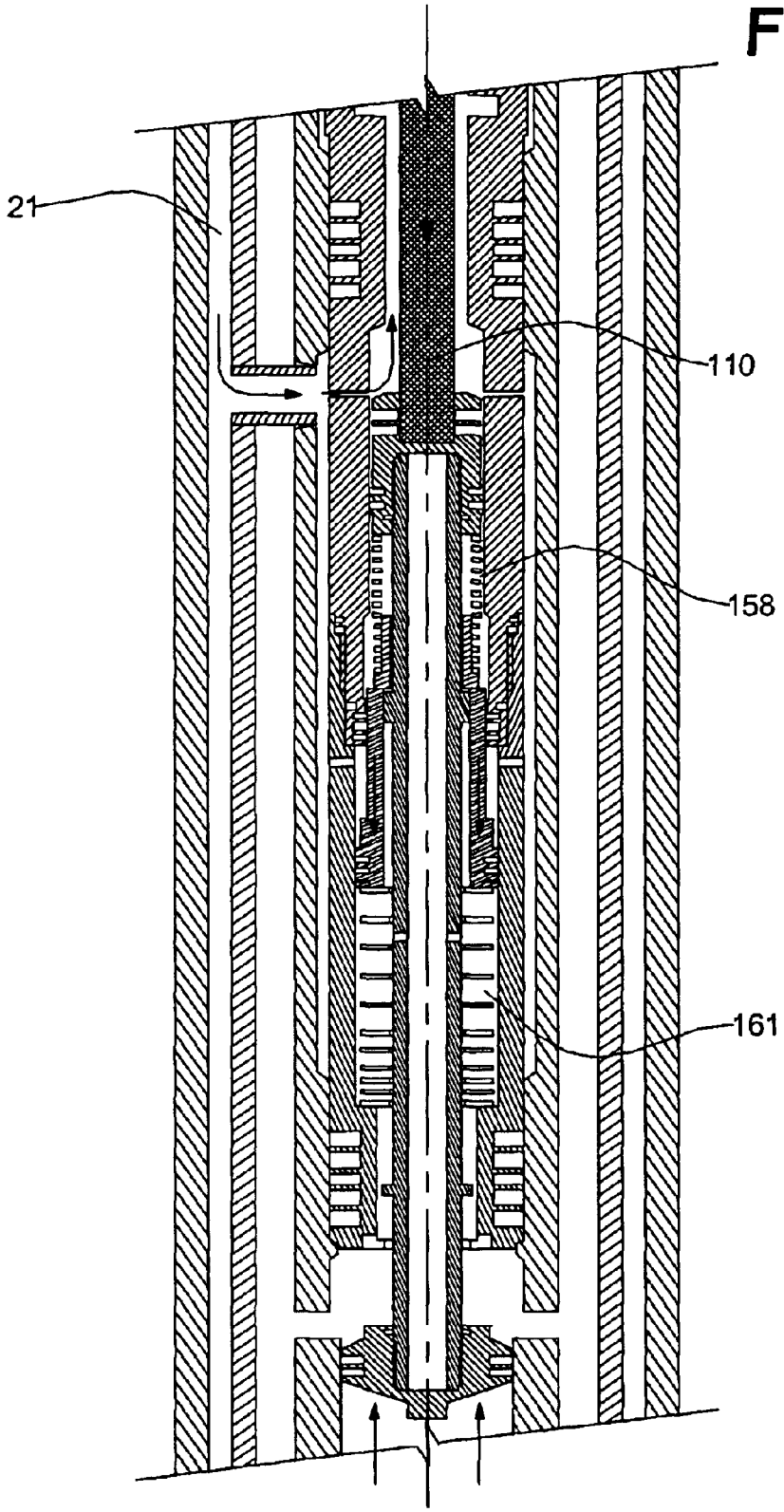
FIG. 6 is a detailed cross-sectional view of the poppet valve of FIG. 5 shown in position at the start of the unloading cycle.
Figure 7:
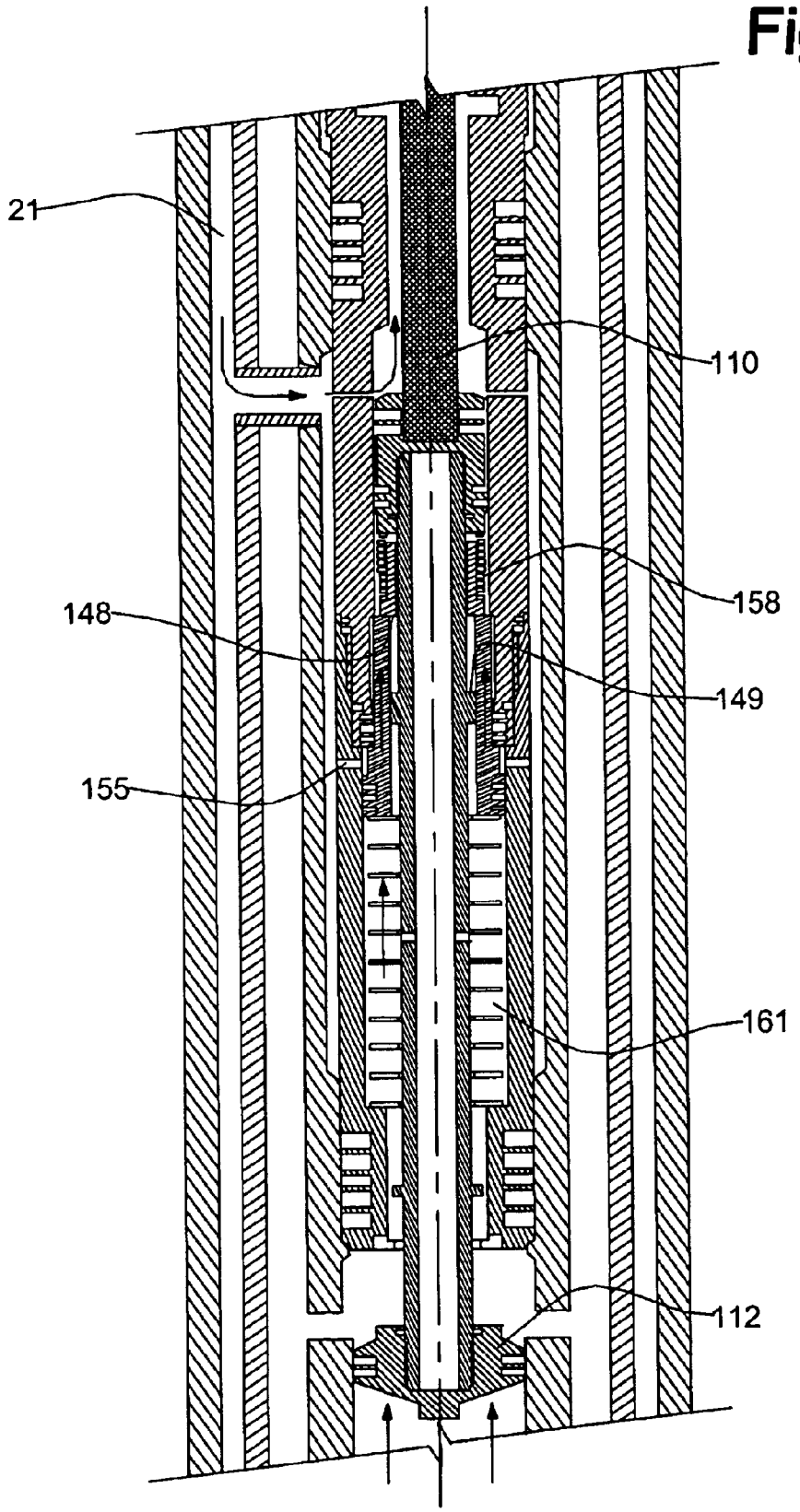
FIG. 7 is a detailed cross-sectional view of the poppet valve of FIG. 5 shown in position at the end of the unloading cycle.

As shown in FIGS. 5–7, the operation of the poppet valve is a result of pressure changes in the annulus 21 relative to the pressure in the reservoir 16. The poppet valve 150 acts to assist the valve stem 110 movement in both the lift position as a result of plunger 18 impact and in the production position as a result of differential pressure.

At the end of a production cycle, as shown in FIG. 5, the pressure in the annulus 21 approaches a predetermined high pressure threshold. The pressure in the gallery 154 increases as a result of high pressure gas entering via the unloading port 102. The gas 25 acts at an upper face 13 of the lower piston 156, driving the piston downwardly, urging poppet shoulder 148 to engage shoulder 149 and preload the valve stem 110 downwardly.

In the illustrated embodiment, the resulting preload on the poppet valve 150 is insufficient to actuate the valve stem 110. In an alternate embodiment, the spring loads and differential pressures can be balanced to enable pressure differential operation on the poppet to operate the valve stem without the need for contact by the plunger.

The valve stem 110 has not yet been contacted by the plunger 18 and therefore remains in the production position.

As shown in FIG. 6, when the pressure in the annulus 21 reaches the threshold, the plunger (not shown) is released from the lubricator (not shown) and falls down the tubing string 11 to contact the uphole end 134 of the valve stem 110. The valve stem 110 moves more readily to the lift position as a result of differential pressure on the poppet valve 150. The upper spring 158 is caused to relax and the lower spring 161 to compress.

Having reference to FIG. 7, when the pressure in the annulus 21 has been relieved, the pressure acting at the gallery ports 155 is no longer high enough to compress the lower spring 161, which returns to its relaxed position. The poppet valve 150 moves freely upwardly which acts to compress the upper spring 158 upwardly, preloading the upper piston 111. The pressure in the reservoir 16, now larger than that in the annulus 21, acts on the downhole piston 112 to move the valve stem 110 to the production position, once again.

Figure 8:
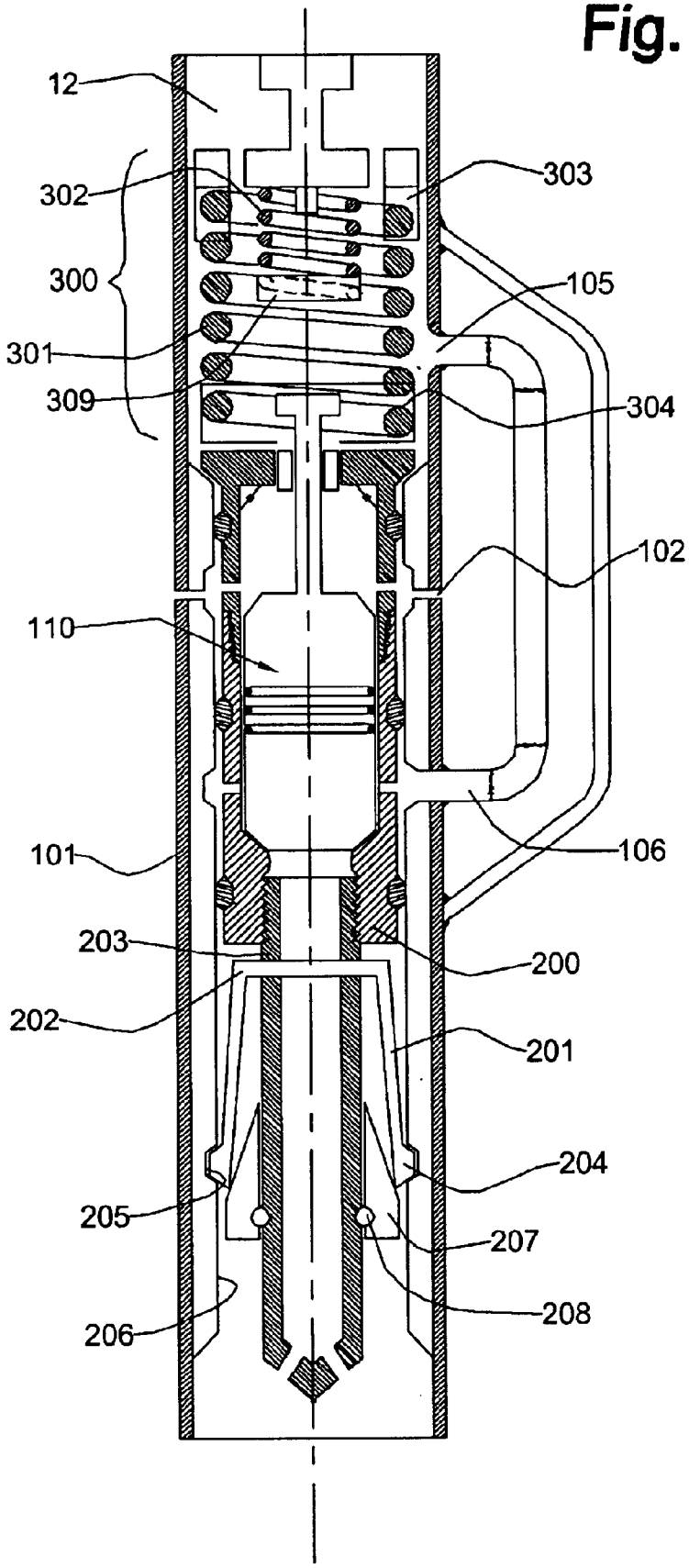
FIG. 8 is a schematic cross-sectional view of an alternate embodiment of the unloading valve of FIG. 3 showing an optional latching mechanism.

Optionally, as shown in FIG. 8, a valve body 200 of an alternate embodiment is retained into the housing 101 using an implementation of a conventional latching mechanism 201. One such mechanism comprises a ring 202 formed about a lower exterior surface 203 of the valve body 200, having a plurality of outwardly extending profiled dogs 204 which are designed to fit a plurality of corresponding profiles 205 in the housing's interior wall 206. Outwardly extending inclined cam surfaces 207 attached to the valve body 200 below the dogs 204, bias the dogs 204 outwardly into engagement with the housing's profiles 205. The axially moveable cam surfaces 207 are connected to the valve body 200 using shear pins 208. When the valve body 200 is retrieved from the housing 101 using wireline, upward pull on the valve body 200 shears pins 208, allowing the inclined cams 207 to fall to a downhole position, enabling the dogs 204 to move inward and release from the housing 101. The valve body 200 can then be retrieved to the surface 19. FIG. 8 also serves to illustrate another embodiment of the valve having a valve stem 110 and ports 102, 105, 106.

Figure 9:
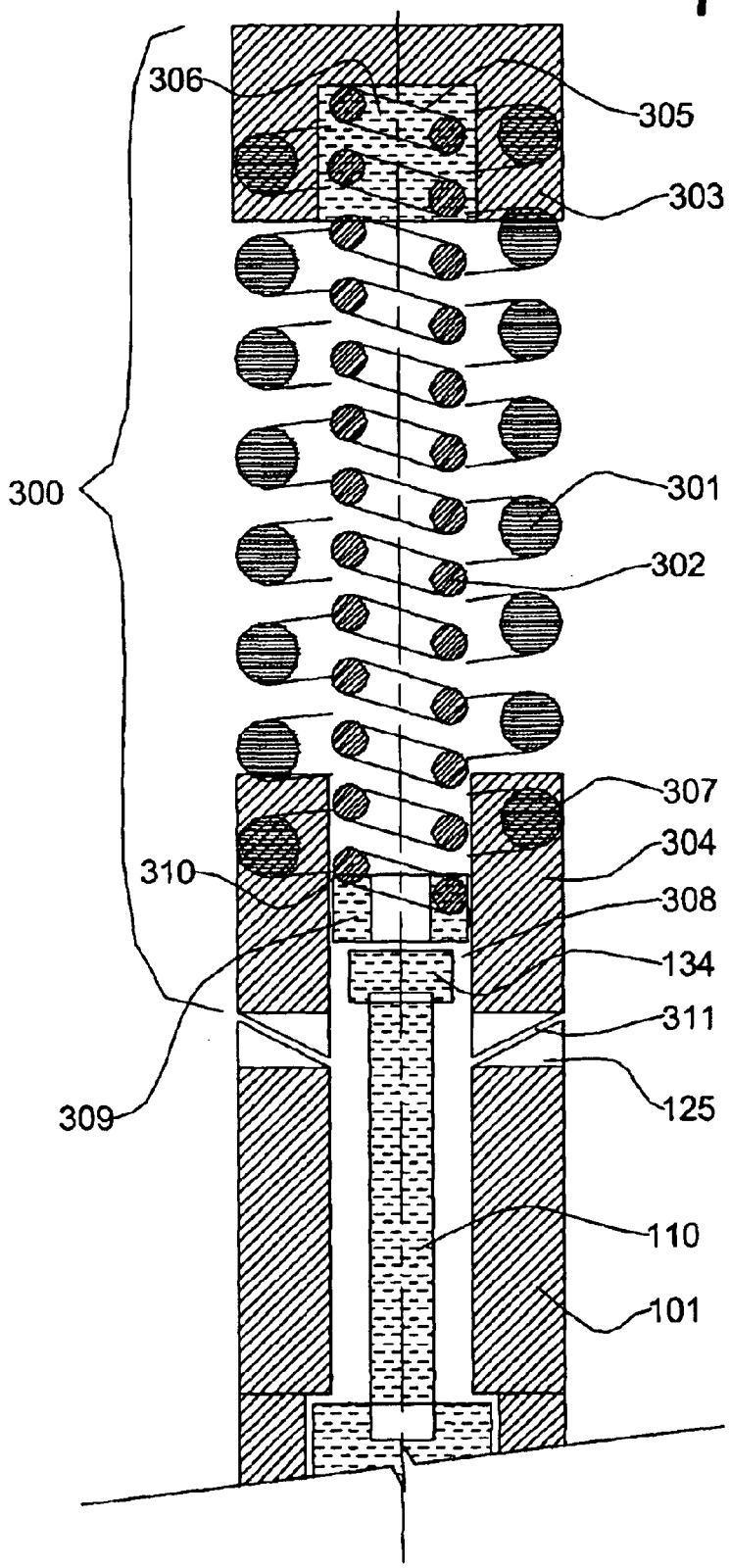
FIG. 9 is a schematic cross-sectional view of an optional plunger landing assembly, positioned at the uphole end of the unloading valve's valve stem.

Having reference to FIGS. 8 and 9 and in another embodiment of the invention, the upper end 134 of the valve stem 110 is fitted with a plunger landing assembly 300 to protect the valve stem 110 from excessive, potentially damaging force exerted by a falling plunger. The plunger landing assembly 300 comprises an outer spring 301 and an inner spring 302. The outer spring 301 is of sufficient size and material strength to withstand the entire force exerted by the falling plunger. The inner spring 302 has an outer diameter such that the inner spring 302 fits freely inside the outer spring 301, and is of sufficient length so that, when the plunger landing assembly 300 is mounted to the top 134 of the valve stem 110, the inner spring 302 is operative to contact with the top 134 of the valve stem 110 when the landing assembly 300 is struck, compressing the outer spring 301. The outer spring 301 is fitted with upper 303 and lower 304 spring retainers.

In the implementation shown in FIG. 9, the upper retainer 303 is a cap having a downward facing internal chamber 305 to which the top flight 306 of the inner spring 302 is attached. The lower spring retainer 304 is an annular ring attached to a bottom flight 307 of the outer spring 301 and having a bore 308 through which the inner spring 302 can move axially therethrough. A circular steel plate 309 is attached to a bottom flight 310 of the inner spring 302 so as to contact the top 134 of the valve stem 110 and transfer the downwardly moving force imparted by the plunger 18. The annular ring 304 at the bottom of the outer spring 301 is profiled at a lower surface 311 to correspond to the angled upward facing end 125 of the valve body 120.

Optionally, as shown in FIG. 8, a standard API fish neck 312 may be attached to the top of the landing assembly 300 to allow the landing assembly 300 to be wireline conveyed into and retrieved from the tubing string 11.

In operation, the falling plunger 18 strikes the top of the landing assembly 300 causing the outer spring 301 to compress and transfer a portion of the downward moving force to the valve housing 101. The remainder of the force is transferred to the valve stem 110 by the inner spring 302. This transferred force is sufficient to move the valve stem 110 axially to the lift position.

In another option, rather that a plunger actuation, the valve 150 may be operated using remote actuation or electrical operation of the valve.

The embodiments of the invention for which an exclusive property or privilege is claimed are defined as follows:

1. A system for enhancing gas recovery from a tubing string extending down a wellbore into a reservoir having diminished pressure, the tubing string accumulating liquid from fluids produced from the reservoir, the system comprising:

a packer sealingly engaged in the wellbore for forming an annulus between an exterior of the tubing string and an interior of a casing string above the packer, the annulus being isolated from the reservoir;

a source of high pressure gas connected to the annulus so as to allow pressure to continuously build within the annulus;

a valve located in a bore of the tubing string adjacent the packer the valve comprising a tubular housing threaded for connection to the tubing string, a tubular valve body housed within a bore of the tubular housing; and a valve stem the valve stem being housed within a bore of the valve body and being axially movable therein between a uphole production position and a downhole lift position to alternately open and block one or more production ports and block and open the one or more unloading ports, respectively; and means for actuating the valve stem from the uphole production position to a downhole lift position, wherein in the uphole production position the one or more production Dolls are opened for fluidly connecting the reservoir to the tubing string above the valve for producing gas from the reservoir and the one or more unloading ports, connecting the annulus to the tubing string, are blocked, and in the downhole lift position the one or more production ports am blocked and the one or more unloading ports are open for releasing thigh pressure gas stored in the annulus into the tubing string above the valve to lift and remove accumulated liquids from the tubing string.

2. The system as described in claim 1 wherein the valve stem further comprises:

an uphole piston connected to an uphole portion of the valve stem such that it blocks the one or more unloading ports when the valve stem is in the first-uphole production position and alternately opens the one or more unloading ports when the valve stem is in the downhole lift position; and a downhole piston connected to a downhole end of the valve stem such that it opens a lower production port when in the uphole production position and alternately blocks a bore of the tubular housing when in the downhole lift position.

3. The system as described in claims 2 wherein the valve further comprises:

an upper production port in communication with the tubing string above the valve;

a lower production port in communication with the reservoir below the valve; and a tubular sleeve formed about the housing and sealingly connected to the housing at an uphole end and a downhole end enclosing the upper and lower ports to form an annular bypass chamber for fluidly connecting the upper and lower production ports to bypass the valve.

4. The system as described in claim 2 wherein the means to actuate the valve from the uphole production position to the downhole lift position is impact on the valve stem from a plunger having fallen down the tubing string.

5. The system as described in claim 2 wherein the means to actuate the valve from the downhole lift position to the uphole production position is a differential pressure between the reservoir and the isolated annulus acting on the valve stem.

6. The system as described in claim 2 further comprising a high Pressure gas poppet valve fitted between the valve body and the valve stem and in fluid communication with the annulus, the poppet valve being operable to utilize annulus pressure to assist in axial shifting of the valve stem.

7. The system as described in claim 1 wherein the means to actuate the valve from the uphole production position to the downhole lift position is impact on the valve stem from a plunger having fallen down the tubing string.

8. The system as described in claim 7 wherein the valve further comprises a plunger landing assembly to absorb excess downward force from the impact of the plunger and to transfer sufficient downward force to the valve stem to shift it to the downhole lift position.

9. The system as described in claim 7 further comprising: means for catching and retaining the plunger at a top of the tubing string when the pressure in the annulus is below a predetermined threshold sufficient to lift accumulated liquid to surface; and means for releasing the plunger to drop into the tubing string when the pressure in the annulus reaches the predetermined threshold.

10. The system as described in claim 9 wherein the means to catch and retain the plunger at the top of the tubing string is a spring loaded pin.

11. The system as described in claim 10 wherein the means to release the plunger is a pneumatic controller which acts to retract the spring loaded pin to cause the plunger to fall down the tubing string.

12. The system as described in claim 1 wherein the means to actuate the valve from the downhole lift position to the uphole production position is a differential pressure between the reservoir and the isolated annulus acting on the valve stem.

13. A method of producing gas from a tubing string extending down a wellbore into a reservoir having diminished pressure, the tubing string accumulating liquid, the method comprising:

providing a packer sealingly engaged in the wellbore for forming an annulus between an exterior of the tubing string and an interior of a casing string above the packer, the annulus being isolated from the reservoir, and a valve located in a born of the tubing string adjacent the packer;

pressurizing the annulus;

shuffling the valve between an uphole production position and a downhole lift position wherein in the uphole production position the one or more production ports are open for fluidly connecting the reservoir to the tubing string above the valve while blocking one or more unloading ports connecting the annulus to the tubing string to flow reservoir gas and in the downhole lift position the one or more production ports are blocked and the one or more unloading ports are open to lift accumulated liquids out of the tubing string.

14. The method as described in claim 13 wherein the blocking of the production ports further comprises:

releasing a plunger down the tubing string so as to actuate the valve as a result of impact from an uphole production position wherein the production ports are open and the unloading ports are blocked to a downhole lift position wherein the production ports are blocked and the unloading ports are open.

15. The method as described in claim 14 further comprising the steps of:

catching and retaining the plunger at a top of the tubing string when the pressure in the annulus is below a predetermined threshold sufficient to lift accumulated liquid to surface; and releasing the plunger to drop into the tubing string when the pressure in the annulus reaches the predetermined threshold.

16. The method as described in claim 13 further comprising:

compressing gas and introducing it into the annulus so as to pressurize the annulus.

* * * * *